US005916120A

United States Patent [19]

Zott

[11] Patent Number: 5,916,120

[45] Date of Patent: Jun. 29, 1999

[54] SUPPORTING DISK FOR A SUPPORT DISK BEARING OF OPEN-END SPINNING ROTORS

[75] Inventor: Werner Zott, Donzdorf, Germany

[73] Assignee: Spindelfabrik Suessen Schurr Stahlecker & Grill GmbH, Suessen, Germany

[21] Appl. No.: 08/939,649

[22] Filed: Sep. 29, 1997

[30] Foreign Application Priority Data

Nov. 30, 1996 [DE] Germany ..... 196 49 770

[51] Int. Cl.[6] ..... D01H 4/00

[52] U.S. Cl. ..... 57/406; 384/549

[58] Field of Search ..... 57/404, 406, 407; 384/549, 295

[56] References Cited

U.S. PATENT DOCUMENTS

| | | | |
|---|---|---|---|
| 4,676,673 | 6/1987 | Stachlecker et al. | 384/549 |
| 4,890,942 | 1/1990 | Raasch | 57/406 |
| 4,892,422 | 1/1990 | Stahlecker | 384/549 |
| 4,893,946 | 1/1990 | Tesh et al. | 384/649 |
| 4,896,976 | 1/1990 | Stahlecker | 384/549 |
| 4,916,891 | 4/1990 | Landwehrkamp et al. | 57/406 |
| 5,178,473 | 1/1993 | Oexler et al. | 57/406 |
| 5,399,028 | 3/1995 | Raasch | 384/549 |
| 5,423,616 | 6/1995 | Gotz | 57/407 |
| 5,675,964 | 10/1997 | Stahlecker | 57/407 |

FOREIGN PATENT DOCUMENTS

| | | | |
|---|---|---|---|
| 3826851 | 2/1990 | Germany | 57/406 |
| 3826851C2 | 1/1996 | Germany . | |

*Primary Examiner*—William Stryjewski
*Attorney, Agent, or Firm*—Evenson McKeown Edwards & Lenahan, PLLC

[57] ABSTRACT

A supporting disk for a supporting disk bearing of open-end spinning rotors comprises a disk-like metal base body and a thin running ring made of plastic. The outer diameter of the running ring measures at least 75 mm. The width of the running ring amounts to at most a tenth of its outer diameter. With these dimensions, the supporting disk can withstand the heat load at rotor speeds of over 130,000 rpm, so that often so-called cooling grooves and anchoring grooves can be omitted.

20 Claims, 2 Drawing Sheets

SUPPORTING DISK FOR A SUPPORT DISK BEARING OF OPEN-END SPINNING ROTORS

BACKGROUND AND SUMMARY OF THE INVENTION

This application claims the priority of 196 49 770.1 filed in Germany on Nov. 30, 1996, the disclosure of which is expressly incorporated by reference herein.

The present invention relates to a supporting disk for a supporting disk bearing of open-end spinning rotors, said supporting disk comprising a disk-like metal base body and a thin plastic running ring, whose outer diameter amounts to at least 75 mm.

In German published patent application 38 26 851 C2, which describes a supporting disk of this type, it is given that the heat load of the plastic running ring increases with increasing width of the running surface and with decreasing outer diameter of the running ring. At the same time it is disclosed that the mechanical load, caused by the pressing of the rotor shaft, decreases with a wider running surface and increases with a larger outer diameter. Arising out of these two opposing tendencies, a compromise is disclosed for the known supporting disk with respect to the dimensional ratios, whereby with an outer diameter of 78 mm and a thickness of the running ring of 4 mm, the width of the running ring—after deduction of 1 mm for a cooling groove—should measure at least 8 mm.

In U.S. Pat. No. 4,916,891 supporting disks are disclosed which, at an outer diameter of the running ring of 70 to 80 mm, may have no cooling groove, as long as the base body is made of a good heat conducting material and the thickness of the running ring does not measure more than 3 mm. From the details given in the publication, a width of the running ring of 10 to 12 mm at the given values can be indirectly ascertained.

It is an object of the present invention to optimize further a supporting disk of the above mentioned type and in particular with regard to the undesirable heat build up of the running ring, to make the supporting disk more resistant, without a cooling groove being absolutely necessary.

This object has been achieved in accordance with the present invention in that the width of the running ring measures at most a tenth of its outer diameter.

It has been shown that by using a metal base body, that is, one which conducts heat well, and a relatively thin running ring, a so-called cooling groove, that is, a circumferential groove in the running surface, can as a rule be omitted even at high speeds of over 130,000 rpm, when the width of the running ring is sufficiently narrow, measuring preferably only 5 to 7 mm. While up to the present, mechanical loads were taken up by the widest possible running ring, and the heat load was kept to acceptable limits either by means of a cooling groove or a particularly thin coating, in the present invention the supporting disk is made as narrow as possible, whereby the heat load is obviously unable to reach a certain maximum in the first place. Nevertheless an additional cooling groove can provide further improvements if required.

The thickness of the running ring measures approximately 4 mm. This is on the one hand thin enough to transport heat quickly over the base body, and on the other thick enough to provide sufficient damping for the supportable shaft of the open-end spinning rotor. In the case of the given dimensions, an anchoring groove between the base body and the running ring can, in many cases, be omitted.

The carrying off of heat can be improved when turbulent air streams are avoided as far as possible on the supporting disk. For this reason, it is provided in a further embodiment of the present invention that the supporting disk has a smooth closed front surface, which is preferably slightly crowned.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
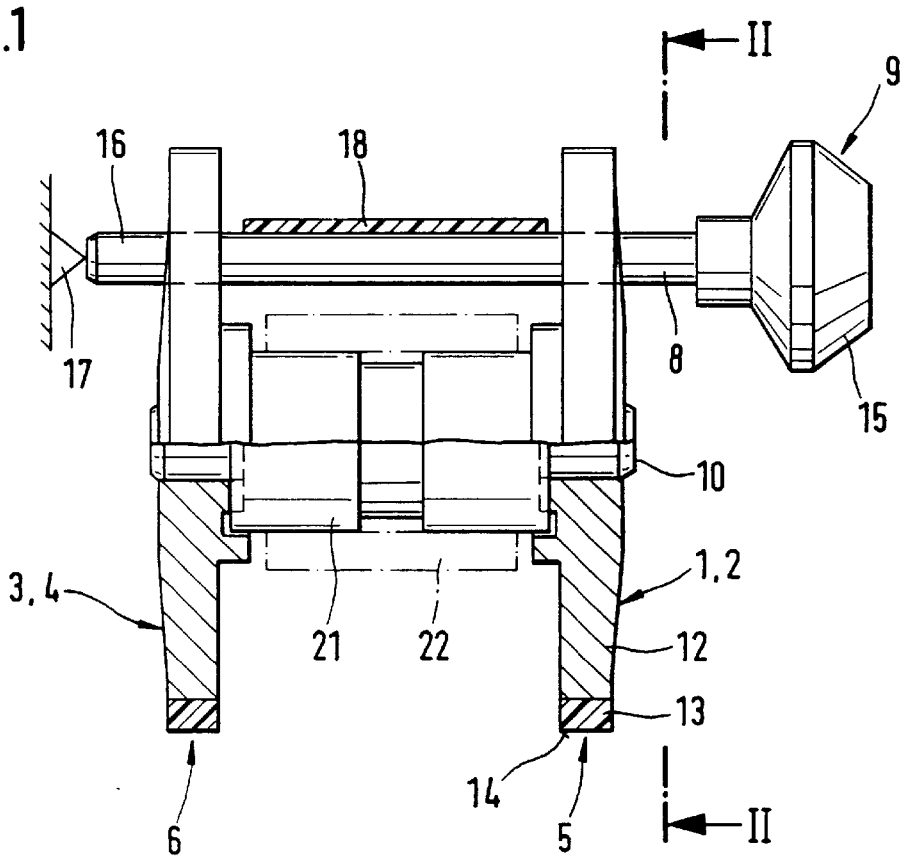
FIG. 1 is a partly sectioned longitudinal view of a supporting disk bearing according to the present invention.
Figure 2:
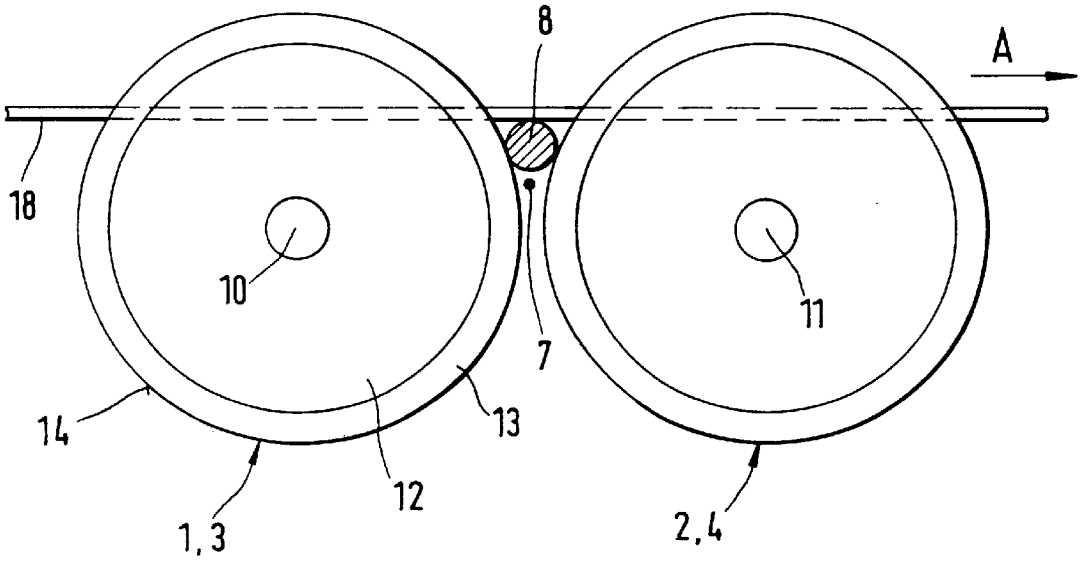
FIG. 2 is a slightly reduced view along the line of intersection of II—II of FIG. 1.
Figure 3:
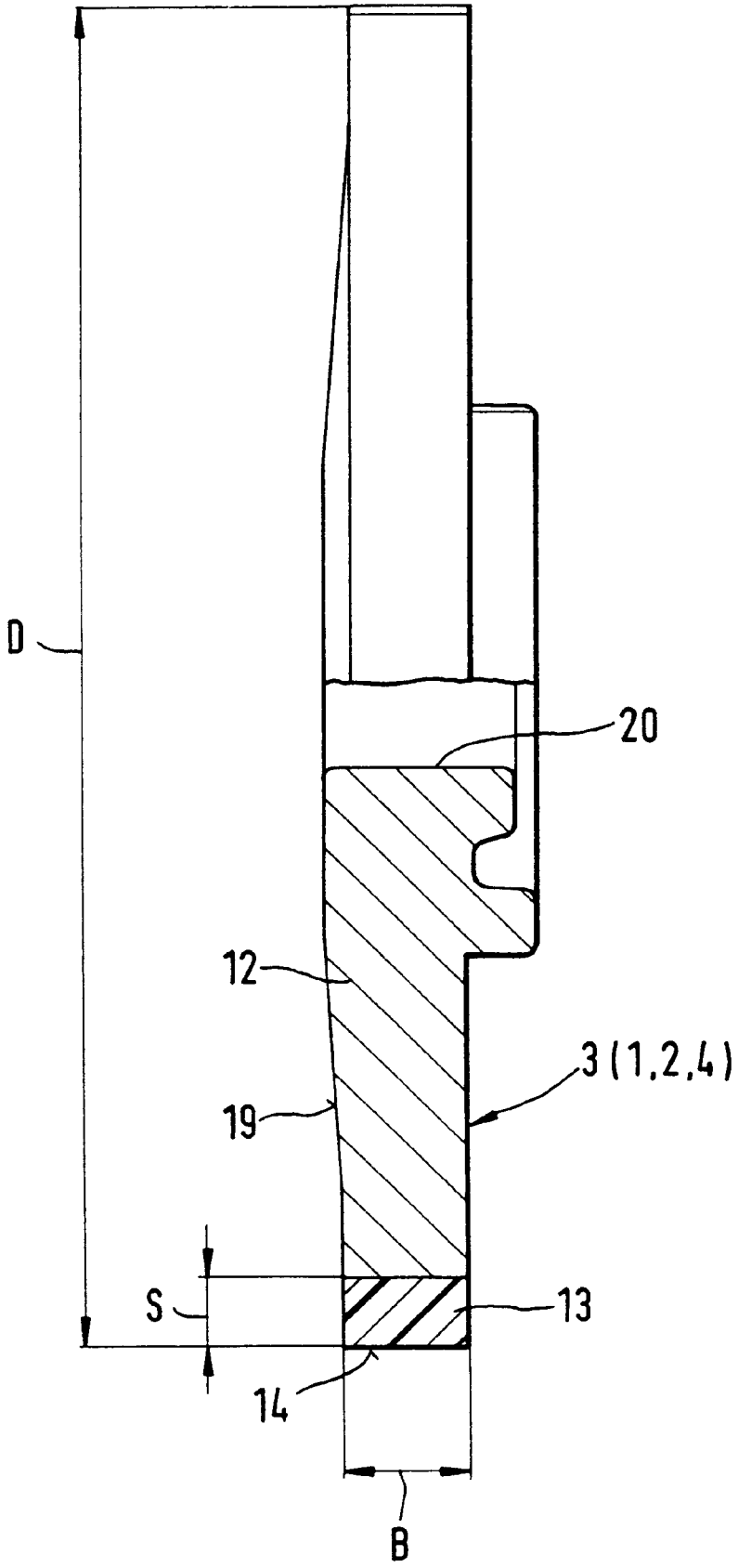
FIG. 3 is a greatly enlarged view of a single supporting disk.

The supporting disk bearing shown in the Figures comprises four supporting disks 1,2,3 and 4, which are arranged in pairs. The two pairs 5 and 6 form wedge shaped gaps 7, in which the shaft 8 of an open-end spinning rotor 9 is supported in a known way. The supporting disks 1,3 or 2,4 located on one side adjacent to the shaft 8 are arranged on a common axle 10 or 11.

The supporting disks 1,2,3 and 4 are essentially similarly constructed. They are each made of a metal base body 12, which must be a good heat conductor, and whose outer periphery is provided with a running ring 13. The four running rings 13 form a running surface 14 for the shaft 8 of the open-end spinning rotor 9. Each running ring 13 is made of an elastomer plastic and is ground on its running surface 14.

The base body 12 is preferably made of an aluminum alloy.

The shaft 8 of the open-end spinning rotor 9 supports at one end a rotor cup 15. The other end of the shaft 8 is supported in axial direction against a step bearing 17 (only schematically shown). The shaft 8 is driven by means of a tangential belt 18, which extends in running direction A in longitudinal direction of the open-end spinning machine, said tangential belt 18 driving the open-end spinning rotors 9 of at least one machine side.

The supporting disk bearing is so arranged that it is suitable for speeds of the open-end spinning rotor 9 of more than 130,000 rpm. The diameter of the shaft 8 of the open-end spinning rotor 9 lies in the range between 8 and 8.5 mm. The supporting disks 1,2,3 and 4 have on their running surfaces 14 an outer diameter D of at least 75 mm, preferably 78 mm, so that at the given speeds a sufficiently long rotational path and thus an efficient carrying off of heat is possible. In addition it is necessary that at the outer diameter D of the running ring 13, the thickness s and the width B of the running ring 13 are adapted accordingly. Preferred is a thickness s of 4 mm and a width B which should be no more than a tenth the width of the outer diameter D. Preferred is a width B between 5 and 7 mm.

The given dimensional rules are not only a compromise between the mechanical load and the heat load, but in many cases also make a so-called cooling groove superfluous, even when this may very well be present in certain cases.

The carrying off of heat is particularly intensive when the front surfaces 19 of the individual supporting disks 1,2,3 and 4 are closed and smooth and preferably slightly crowned.

It has been shown that in the case of a thin running ring 13 with a thickness s of only 4 mm and the other dimensions mentioned above, not only can a cooling groove be omitted, but also any anchoring groove with the base body 12.

The supporting disks 1,2,3 and 4 are each provided with a centrical bore hole 20, with which the said supporting disks 1,2,3 and 4 are placed on the relevant axle 10 or 11. The axles 10 and 11 in turn are each taken up by a bearing housing 21, to which a bearing support 22 is arranged, shown only by a dot-dash line, said bearing support 22 being mounted on the machine frame.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A supporting disk for a supporting disk bearing of open-end spinning rotors, said supporting disk comprising a disk-like metal base body and a thin running ring connected to and surrounding the base body, said running ring being made of plastic and having an outer diameter which measures at least 75 mm, wherein the width of the running ring in an axial direction of the supporting disk measures at most a tenth of the outer diameter of the running ring.

2. A supporting disk according to claim 1, wherein the width of the running ring measures between 5 and 7 mm.

3. A supporting disk according to claim 2, wherein the radial thickness of the running ring measures approximately 4 mm.

4. A supporting disk according to claim 3, wherein the running ring outer diameter is about 78 mm.

5. A supporting disk according to claim 2, wherein the running ring has a uniformly smooth running surface.

6. A supporting disk according to claim 2, wherein the running ring is arranged at the base body without any anchoring profile.

7. A supporting disk according to claim 2, wherein the running ring outer diameter is about 78 mm.

8. A supporting disk according to claim 1, wherein the radial thickness (s) of the running ring measures approximately 4 mm.

9. A supporting disk according to claim 8, wherein the running ring has a uniformly smooth running surface.

10. A supporting disk according to claim 8, wherein the running ring is arranged at the base body without any anchoring profile.

11. A supporting disk according to claim 1, wherein the running ring has a uniformly smooth running surface.

12. A supporting disk according to claim 11, wherein the running ring is arranged at the base body without any anchoring profile.

13. A supporting disk according to claim 1, wherein the running ring is arranged at the base body without any anchoring profile.

14. A supporting disk according to claim 1, wherein the supporting disk has a smooth closed axial end face surface facing in one axial direction of the supporting disk to thereby facilitate intensive heat transfer therefrom.

15. A supporting disk according to claim 14, wherein the end face surface is slightly crowned.

16. A supporting disk according to claim 15, wherein the width of the running ring measures between 5 and 7 mm.

17. A supporting disk according to claim 16, wherein the radial thickness of the running ring measures approximately 4 mm.

18. A supporting disk according to claim wherein the radial thickness of the running ring measures approximately 4 mm.

19. A supporting disk according to claim 18, wherein the running ring is arranged at the base body without any anchoring profile.

20. A supporting disk according to claim 1, wherein the running ring outer diameter is about 78 mm.

* * * * *